US006237379B1

(12) United States Patent
Hötzl

(10) Patent No.: US 6,237,379 B1
(45) Date of Patent: May 29, 2001

(54) MOTOR-ASSISTED ELECTROMECHANICAL LOCK SYSTEM

(75) Inventor: Manfred Hötzl, Graz (AT)

(73) Assignee: Roto Frank Eisenwarenfabrik AG, Kalsdorf bei Graz (AT)

( * ) Notice: Subject to any disclaimer, the term of this patent is extended or adjusted under 35 U.S.C. 154(b) by 0 days.

(21) Appl. No.: 09/293,830

(22) Filed: Apr. 16, 1999

(30) Foreign Application Priority Data

Apr. 17, 1998 (AT) ..... 653/98

(51) Int. Cl.[7] ..... E05B 47/00

(52) U.S. Cl. ..... 70/279.1; 70/406; 70/395; 70/278.2

(58) Field of Search ..... 70/276, 277, 278.1, 70/278.2, 278.3, 278.7, 279.1, 283, 280–282, 395, 400, 405, 406

(56) References Cited

U.S. PATENT DOCUMENTS

| | | | | |
|---|---|---|---|---|
| 3,942,347 | * | 3/1976 | Coleman | 70/395 |
| 5,202,580 | * | 4/1993 | Janssen | 70/276 |
| 5,404,737 | * | 4/1995 | Hötzl | 70/279.1 |
| 5,469,727 | * | 11/1995 | Spahn et al. | 70/277 |
| 5,628,217 | * | 5/1997 | Herrera | 70/279.1 |
| 5,629,505 | * | 5/1997 | Cryer | 700/61.54 |
| 5,691,711 | * | 11/1997 | Jorgensen | 70/278.1 |
| 5,791,177 | * | 8/1998 | Bianco | 70/283 |
| 5,839,305 | * | 11/1998 | Aston | 70/278.1 |
| 5,946,956 | * | 9/1999 | Hötzl | 70/276 |

FOREIGN PATENT DOCUMENTS

| | | |
|---|---|---|
| 92 07 789 U | 10/1992 | (DE) . |
| 93 03 702 U | 8/1994 | (DE) . |
| 0 779 404 | 6/1997 | (EP) . |
| 2 176 531 | 12/1986 | (GB) . |

* cited by examiner

*Primary Examiner*—Darnell Boucher
(74) *Attorney, Agent, or Firm*—Herbert Dubno; Andrew Wilford

(57) ABSTRACT

A lock system has a housing, a barrel rotatable in the housing, tumblers radially displaceable in the barrel and housing between an unlocked position permitting the barrel to rotate in the housing out of a center position and a locked position blocking rotation of the barrel in the housing and retaining the barrel in the center position, and an actuating element rotatable in the housing about the axis and juxtaposed with an inner end of the barrel. Lock members are operable by the element and a switch in the housing is operable by the barrel on displacement out of the center position to energize an electric motor that can rotate the element and thereby mechanically operate the lock members. A key fittable in the barrel is displaceable axially therein through an axial stroke between an outer position and an inner position. The key is formed with bit surfaces extending axially through a distance equal at least to the stroke and is engageable with the tumblers to hold the tumblers in the unlocked position in both the inner and outer key positions. The key has a tip projecting in the inner key position into the actuating element and rotationally coupling the actuating element to the barrel and standing clear of the element in the key outer position and decoupling the element from the barrel so that in the inner position the key can turn the element directly while in the outer position the element can only be turned by the motor.

4 Claims, 2 Drawing Sheets

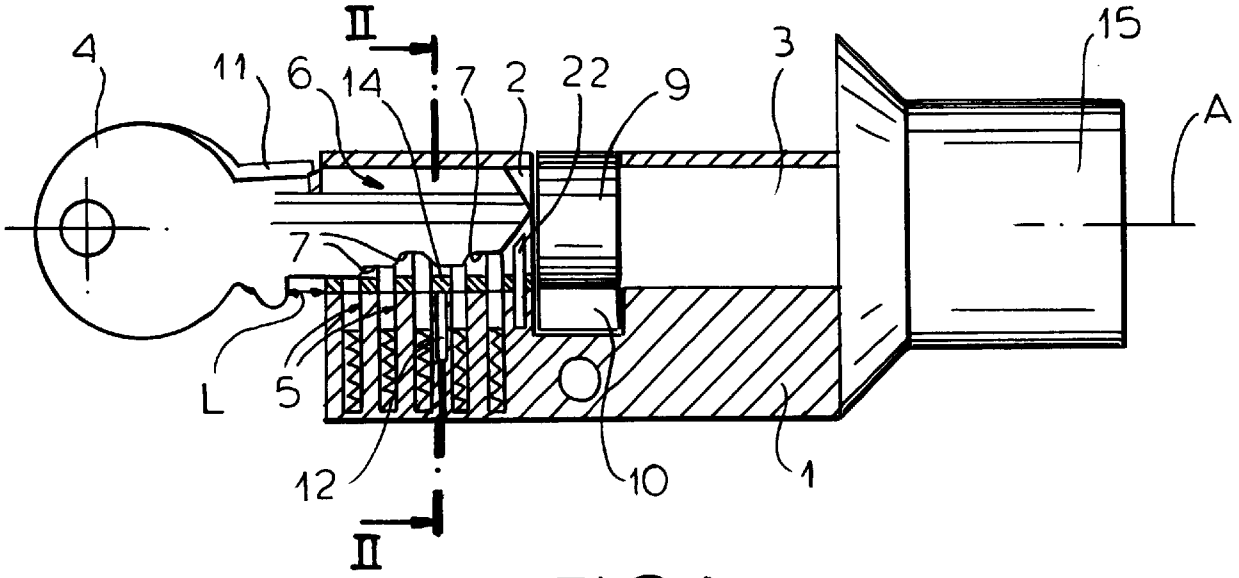
FIG.1
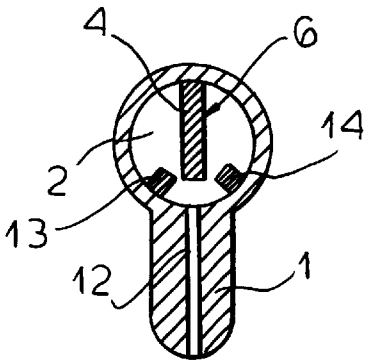
FIG.2
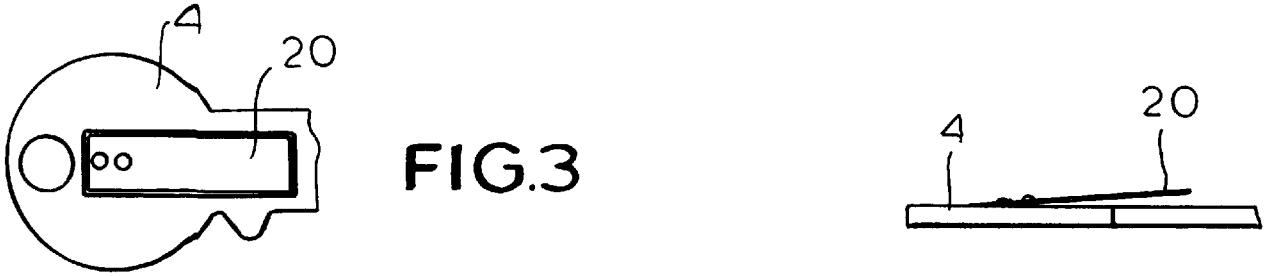
FIG.3
FIG.4

MOTOR-ASSISTED ELECTROMECHANICAL LOCK SYSTEM

FIELD OF THE INVENTION

The present invention relates to an electromechanical lock system. More particularly this invention concerns such a system having a motor that offers a power assist to the operation of the key.

BACKGROUND OF THE INVENTION

A standard motor-assist door latch is described in U.S. Pat. No. 5,394,718 of Hotzl as having a main lock housing, a bolt movable in the housing between a locked position projecting from the housing and an unlocked position largely recessed in the housing, a key-operable mechanism having an actuator movable by turning of an appropriately bitted key in the mechanism, and a linkage between the actuator and the bolt for displacing the bolt by means of the actuator. A secondary housing is provided adjacent the lock housing and an actuator element coupled and movable with the linkage extends from the lock housing to the secondary housing. The element moves in one direction relative to the secondary housing on movement of the bolt from the locked to the unlocked position and in the opposite direction on movement of the bolt from the unlocked to the locked position. An electric motor on the secondary housing connected to the element is energizable for displacing same in both directions and thereby also displacing the bolt between its positions. Switches on the secondary housing juxtaposed with the element and connected to the motor detect movement of the element in either direction when actuated through the linkage by the key and energize the motor to move the element in the same direction it is already moving in. Thus the motor gives the key a sort of power assist.

Such an assembly is typically used to operate a high-security multibolt door lock which presses bolts in several directions into the jamb. Thus the motor is normally needed to move the considerable amount of equipment that must be displaced to lock and unlock the door. Even if all the various bolts and linkages are finely machined and oiled, they nonetheless constitute quite some mass that would make turning the key a serious chore and, therefore, would militate against use of the lock.

The obvious problem with this type of motor-assisted lock is that if the power fails the door is locked and cannot be opened. It becomes necessary to provide some sort of auxiliary unlocking mechanism that not only unnecessarily augments the cost of the lock, but presents a weak point at which the lock can be attacked for unauthorized entry.

OBJECTS OF THE INVENTION

It is therefore an object of the present invention to provide an improved motor-assist electromechanical lock system.

Another object is the provision of such an improved motor-assist electromechanical lock system which overcomes the above-given disadvantages, that is which can be operated mechanically if the power for its motor fails.

SUMMARY OF THE INVENTION

A lock system has according to the invention a housing, a barrel rotatable in the housing about an axis from a center position, tumblers radially displaceable in the barrel and housing between an unlocked position permitting the barrel to rotate in the housing out of the center position and a locked position blocking rotation of the barrel in the housing and retaining the barrel in the center position, and an actuating element rotatable in the housing about the axis and juxtaposed with an inner end of the barrel. Lock members are operable by the element and a switch in the housing is operable by the barrel on displacement out of the center position to energize an electric motor that can rotate the element and thereby mechanically operate the lock members. According to the invention a key fittable in the barrel is displaceable axially therein through an axial stroke between an outer position and an inner position. The key is formed with bit surfaces extending axially through a distance equal at least to the stroke and is engageable with the tumblers to hold the tumblers in the unlocked position in both the inner and outer key positions. The key has a tip projecting in the inner key position into the actuating element and rotationally coupling the actuating element to the barrel and standing clear of the element in the key outer position and decoupling the element from the barrel so that in the inner position the key can turn the element directly while in the outer position the element can only be turned by the motor.

Thus with this system when the key is in the outer position it serves merely to rotate the barrel and operate the switch, thereby functioning like a standard motor-assisted lock. If the electrical power supply for the motor fails, however, the key can be pushed into the inner position in which it will physically connect with the actuating element that it otherwise normally only operated by the motor, so that this actuating element can itself be operated by the key. Thus the lock has, in affect, a mechanical override that in no way compromise its security and that adds little to the cost of the system.

The key according to the invention is provided with an abutment displaceable between a blocking position engageable with the barrel and inhibiting axial displacement of the key into the inner position and a freeing position permitting axial displacement of the key into the inner position. This abutment, which can be formed by an elastically deflectable plate fixed on the key, therefore normally inhibits movement into the inner position for normal operation of the latch. Only in an emergency is it deflected out of the way so the key can assume the inner position.

In another system in accordance with the invention the abutment is electromagnetically normally urged into the blocking position and only moves into the freeing position when an electric power source for itself and the motor fails. Thus when power fails the user does not need to take any special steps and will merely find that his or her key does farther into the lock, then rotates through a larger angle and is somewhat harder to turn, as it is directly operating the mechanical elements of the lock, but otherwise use of the lock will be identical as in motor-assist mode.

BRIEF DESCRIPTION OF THE DRAWING

The above and other objects, features, and advantages will become more readily apparent from the following description, reference being made to the accompanying drawing in which:

FIG. 1 is an axial section through the lock assembly according to the invention with its key in the outer motor-assisted position;

FIG. 2 is a section taken along line II—II of FIG. 1;

FIGS. 3 and 4 are side and top views of a variant on the key of the lock in accordance with the invention;

SPECIFIC DESCRIPTION

Figure 6:
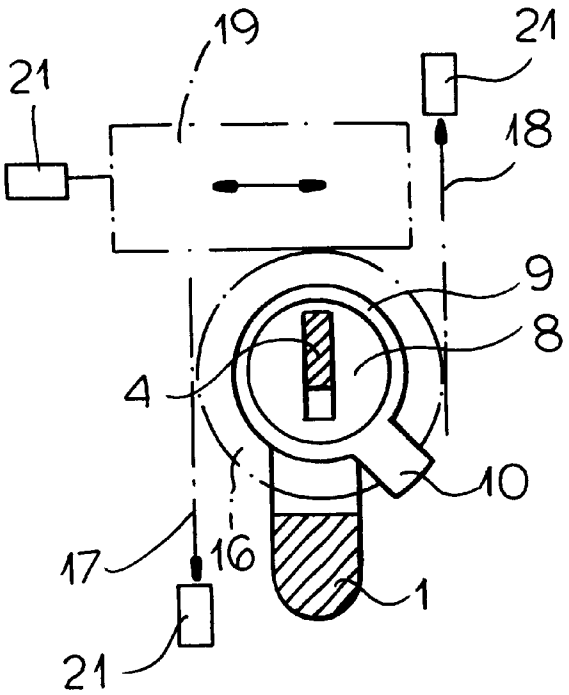
FIG. 6 is a partly diagrammatic section taken along line VI—VI of FIG. 5.

As seen in FIGS. 1, 2, 5, and 6, a lock assembly according to the invention has a housing 1 in which a standard barrel 2 is rotatable about an axis A. A key 4 can be inserted into a passage 6 of the barrel 2 and has bit surfaces 7 engageable with standard spring-loaded two-part tumblers 5 projecting radially inward from the housing 1 into the barrel 2. As is standard, when each of the tumblers 5 engages a bit at a predetermined spacing inward of the outer wall of the barrel 2, the split of that tumbler 5 will fall just at the cylindrical interface between the housing 1 and barrel 2 and will not impede rotation of the barrel 2 in the housing 1.

The barrel 2 carries offset about 30° to each side of the plane of the tumblers 5 small magnets 13 and 14 (FIG. 2) which can operate a reed switch 12 connected to a motor unit 15 mounted on an inner end of the lock. A second barrel 3 with no tumblers connects this motor 15 to a mechanical actuating element 9 having a radially projecting nose 10. The nose 10 can operate a mechanical bolt. In addition as shown in FIG. 6 the rotatable element 9 can carry a gear 16 that meshes with gears 17, 18, and 19 that are part of or that in turn actuate door bolts shown schematically at 21. The motor unit 15 can be incorporated in the lock elsewhere, but in any case serves to rotate the element 9 and operate the mechanical elements of the lock. Thus the person using the key 4 is merely tripping the switch 12 to lock or unlock the door; the actual work of displacing the bolts 21 is done by the motor 15.

Figure 5:
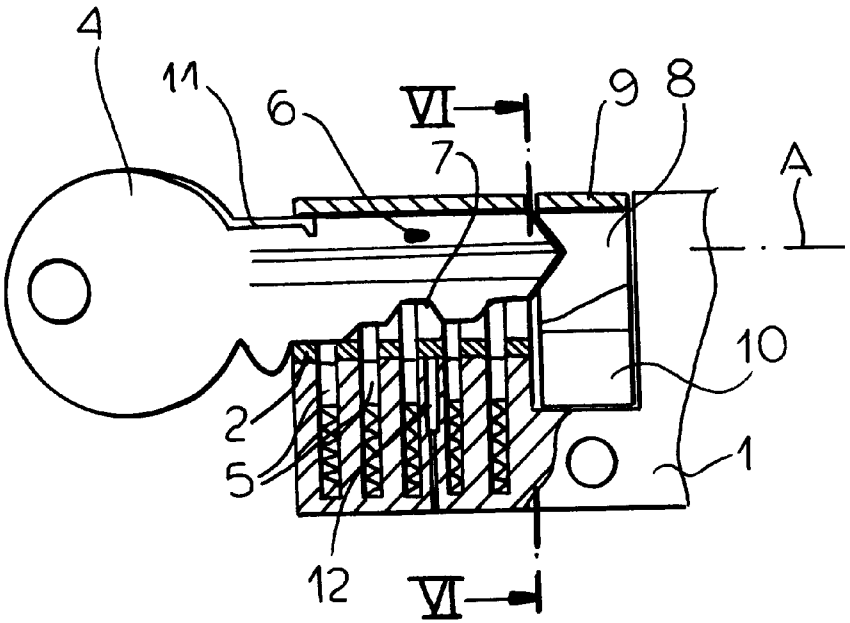
FIG. 5 is a view like FIG. 1 but with the key in the inner emergency-override position.

According to the invention each of the bet surfaces 7 has a length L measured parallel to the axis A which is equal to the axial distance traveled by the key 4 when moving from the outer position shown in FIG. 1 to the inner position shown in FIG. 5. Thus when the key 4 moves between these positions, the radial positions of the tumblers 9 will not change. In the inner position the tip of the key 4 fits into a seat or passage 8 in the element 9. Thus in this inner position the key 4 is mechanically coupled to the element 9 and can itself turn it and mechanically operate the lock.

The key 4 is provided with a deflectable plate 11 forming an abutment that normally inhibits full insertion of the key 4 into the passage 6. Thus under normal circumstances the key 4 only attains the outer position in which its tip is not engaged in the element 9 so as to serve purely for motor-assisted operation of the lock. If, however, the power for the motor 15 fails, the key 4 is inserted fully into the FIG. 5 position by inward deflection of the abutment 11 and can serve for mechanical turning of the element 9. Alternatively a stop such as indicated at 22 in FIG. 1 only can be electromagnetically normally urged into a position blocking movement of the key 4 into the inner position so that only when the power supply fails does it retract and allow the key to move into this inner position. In addition a slide or jaws mounted on the inner end of the barrel 2 can be moved by the key 4 when it passes into the inner position to further couple the barrel 2 and element 9.

FIGS. 3 and 4 show how a plate abutment 20 can be mounted on the side of the key 4 instead of along an upper edge of its blade. Alternately a spring-loaded radially displaceable ball in the barrel 2 and a corresponding pair of seats in the back key edge could be used to define the two key positions.

I claim:

1. A lock system comprising:

a housing;

a barrel rotatable in the housing about an axis from a center position;

tumblers radially displaceable in the barrel and housing between an unlocked position permitting the barrel to rotate in the housing from the center position and a locked position blocking rotation of the barrel in the housing and retaining the barrel in the center position;

an actuating element rotatable in the housing about the axis and juxtaposed with an inner end of the barrel;

lock members operable by the actuating elements;

a switch in the housing operable by the barrel on displacement from the center position;

an electric motor operable by the switch to rotate the actuating element and thereby mechanically operate the lock members; and a key fittable in the barrel and displaceable axially therein through an axial stroke between an outer position and an inner position, the key being formed with bit surfaces extending axially through a distance equal at least to the stroke and being engageable with the tumblers to hold the tumblers in the unlocked position in both the inner and outer key positions, the key having a tip projecting in the inner key position into the actuating element and rotationally coupling the actuating element to the barrel and standing clear of the actuating element in the key outer position and decoupling the actuating element from the barrel, whereby in the inner position the key can turn the actuating element directly while in the outer position the actuating element can only be turned by the motor.

2. The electromechanical lock system defined in claim 1, further comprising:

an abutment displaceable between a blocking position inhibiting axial displacement of the key into the inner position and a freeing position permitting axial displacement of the key into the inner position.

3. The electromechanical lock system defined in claim 2 wherein the abutment is formed by an elastically deflectable plate fixed on the key and it engageable with the barrel in the blocking position.

4. The electromechanical lock system defined in claim 2 wherein the abutment is electromagnetically normally urged into the blocking position and only moves into the freeing position when an electric power source for itself and the motor fails.

* * * * *